United States Patent [19]

Ruegsegger

[11] 4,102,482

[45] Jul. 25, 1978

[54] PROCESS FOR PRODUCING FUSIBLE LINKS

[76] Inventor: Donald Ray Ruegsegger, 425 W. Maple, Waterloo, Ind. 46793

[21] Appl. No.: 761,435

[22] Filed: Jan. 21, 1977

Related U.S. Application Data

[62] Division of Ser. No. 554,650, Mar. 3, 1975, Pat. No. 4,055,829.

[51] Int. Cl.[2] ..... A62C 37/30

[52] U.S. Cl. ..... 228/170; 228/173 D; 29/623; 29/417

[58] Field of Search ..... 169/42; 337/416; 29/623, 417; 228/170, 173 C, 173 D

[56] References Cited

U.S. PATENT DOCUMENTS

| | | | |
|---|---|---|---|
| 911,162 | 2/1909 | Rockwood | 169/42 |
| 1,084,710 | 1/1914 | Rockwood | 169/42 |
| 1,092,562 | 4/1914 | Cotton | 169/42 |
| 1,267,906 | 5/1918 | Rowley | 169/42 |
| 1,613,453 | 1/1927 | Grimshaw | 169/42 |

*Primary Examiner*—Al Lawrence Smith
*Assistant Examiner*—K. J. Ramsey
*Attorney, Agent, or Firm*—John A. Young

[57] ABSTRACT

A pair of substantially flat rectangular fusible links is constructed from progressive dies by partially cutting them from sheet metal stock as blanks, flanging edges on the parts and including the forming of triangular camming surfaces on such flanges, and then shearing the parts from the stock. Thereafter, the links are fluxed and soldered together and are held in interested complementary relation. It is characteristic of the links that there are no voids or discontinuities in the joined surfaces and into which flux will not flow; the interfacing triangular cam surfaces insure a clean breaking apart of the links once the eutectic temperature is reached because any longitudinal sliding movement of the links biases them laterally apart under the camming action to insure a complete break-away of the confronting soldered surfaces.

5 Claims, 14 Drawing Figures

PROCESS FOR PRODUCING FUSIBLE LINKS

RELATED APPLICATION

This present application is a divisional application of U.S. Application Ser. No. 554,650, filed Mar. 3, 1975 in the name of Donald Ray Ruegsegger and entitled, "IMPROVED FUSIBLE LINKS AND PROCESS FOR PRODUCING SAME". This application is now U.S. Pat. No. 4,055,829 issued Oct. 25, 1977.

BACKGROUND OF THE INVENTION

Fusible links have been known to exist and are generally constructed on the principle of being temperature responsive and are held under tension or compression. At the appropriate temperature, the links then separate to enable the actuation of an alarm or other device in response to the occurrence of a predetermined temperature.

Generally, these fusible members (links) work on the same principle, that is they are held together by the eutectic solder or weld and liquify to enable the links to separate when the eutectic temperature is reached. Many different configurations of fusible links have been proposed and while the device is simple in construction, one or the other of previously employed links are unsatisfactory because they tend to "creep", i.e., they tend to allow slippage to occur between the fused parts rather than a clean separation. This means that at the eutectic temperature, instead of fully releasing, the fused parts will tend to move longitudinally without a clean break. In effect this is a malfunctioning of the fuse.

Also, by reason of the shape or configuration of the confronting surfaces of prior fuse elements, it has been found that the solder is unable to completely penetrate and fill the space between the confronting surfaces an consequently there develops voids which make it impossible to obtain a complete solder between the fusible links and thus no uniformity or precision in operation of the fuse is obtainable at the eutectic temperature. It is absolutely essential to obtain precise fuse operation and this is achieveable at least in part by a complete and uniform flux-and-soldering between the surfaces of the link elements.

Additionally, it is desired that there be some way of product identification on the link including trademark and tradename, product number, various approvals, all of which can conveniently be embossed on outer surfaces of the link if such surfaces are available. It is customary also to include, in addition to the manufacturer's logo, any testing laboratory approvals, the temperature at which the fuse should be operated, year of manufacture, etc., all of which are additional safety precautions.

Accordingly, it is an object of the present invention to provide an improved link which is manufacturable from a continuous and progressive die operation, cutting, shaping and forming the links, the end result of which is a pair of interfittable links including cam portions which insure breakaway of the soldered connection whenever there is any relative longitudinal movement between the fuse links.

It is another object of the present invention to provide a pair of internested fuse links which can be fluxed and soldered without any voids, discontinuities or incomplete joinder between the confronting fused surfaces.

It is another object of the present invention to provide complementary interfitted fuse links which can be soldered together to provide a uniform fuse connection precisely separated at the eutectic temperature desired and characterized by provision of a substantial embossing area which can conveniently receive data thereon such as manufacturing year, release temperature, testing laboratory approvals, manufacture and the like.

Other objects and features of the present invention will become apparent from a consideration of the following description which proceeds with reference to the accompanying drawings, wherein a selected example embodiment of the invention is illustrated by way of example and not by way of limitation of the invention.

DRAWINGS

DETAILED DESCRIPTION OF THE INVENTION

Figure 1:
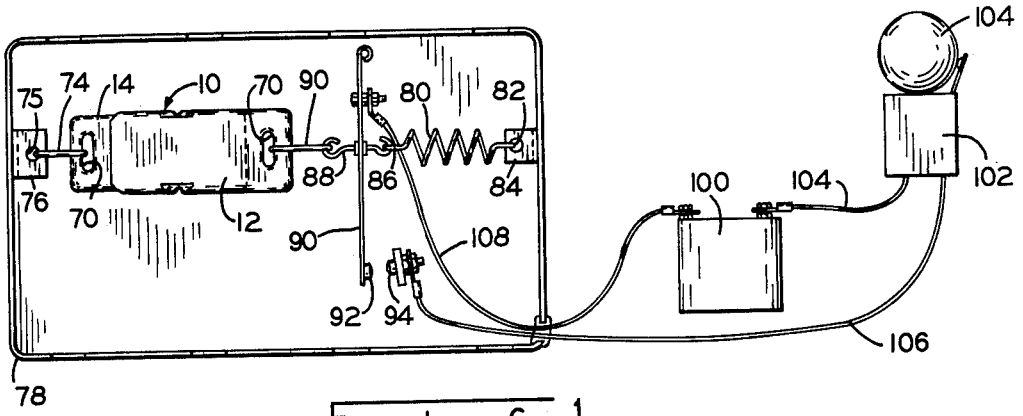
FIG. 1 is a schematic view showing how the fuse is incorporated into an alarm system and is adapted, at the critical temperature, to separate and cause actuation of an alarm bell.
Figure 2:
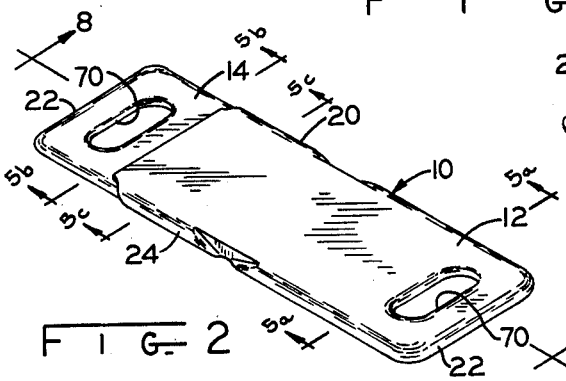
FIG. 2 is an isometric view showing the fuse detached from the system of FIG. 1 and viewed from one side thereof.
Figure 3:
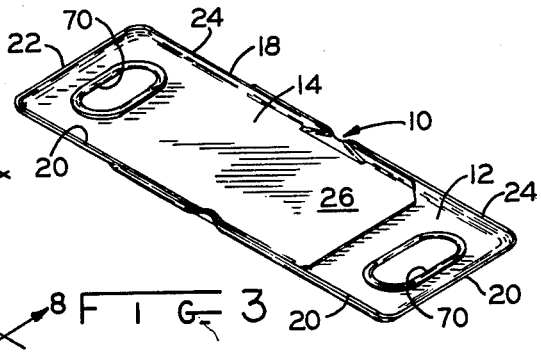
FIG. 3 is also an isometric view illustrating the same fuse as that in FIG. 2 after rotating 180° the fuse of FIG. 2 about its longitudinal axis.
Figure 4:
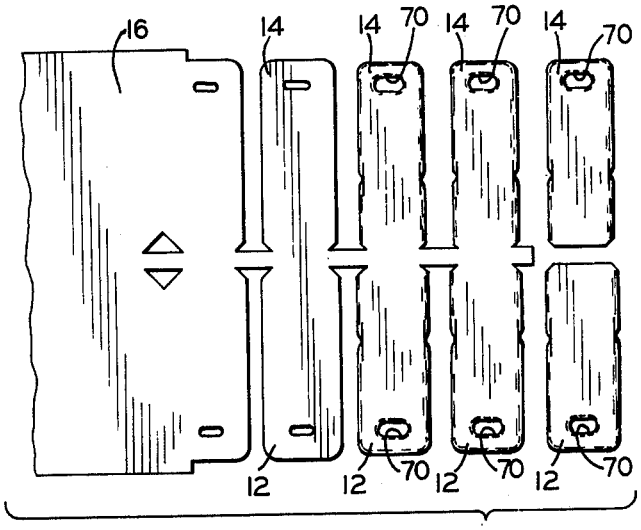
FIG. 4 illustrates the progressive cutting, piercing, embossing, flanging and shearing from sheet metal stock to produce the two complementary fuse sections.
Figure 5A:
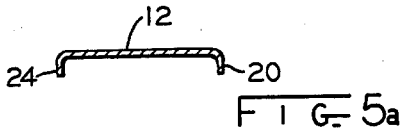
FIGS. 5A, 5B and 5C are sectional views taken on their respective section lines 5A—5A, 5B—5B and 5C—5C of FIG. 2.
Figure 5B:
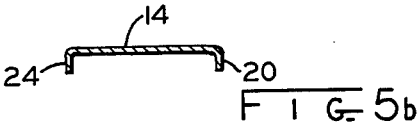
Figure 5C:
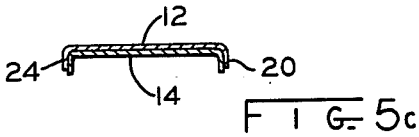
Figure 6:
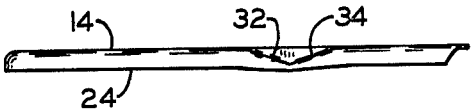
FIG. 6 is a side elevation view of one of the fuse links.
Figure 7:
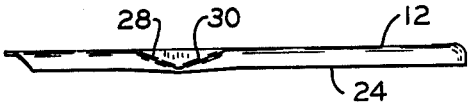
FIG. 7 is a side view of the complementary fuse link before the two are brought together by internesting one within the other as indicated in FIG. 2 and FIG. 3.
Figure 12:
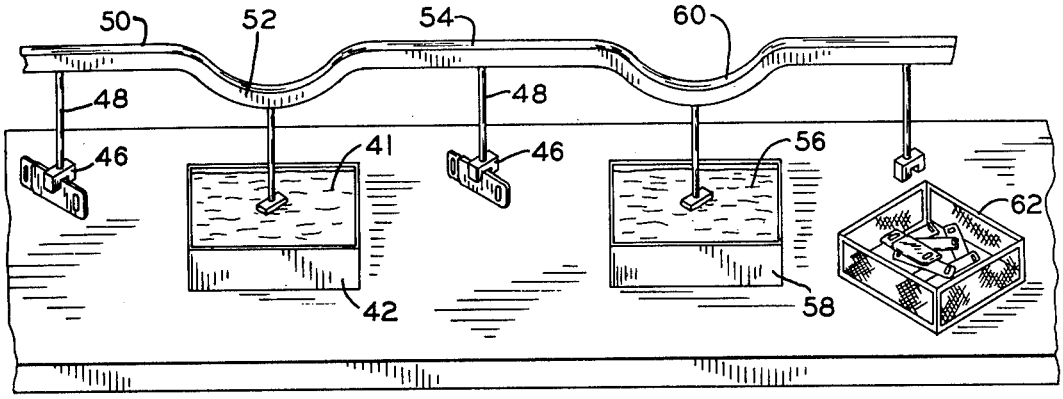
FIG. 12 illustrates a method for continuously passing the fuse elements through a dip-fluxing and dip-soldering tank.

Referring now to the drawings, there is designated generally in FIG. 1, a fuse 10 which, as indicated in FIGS. 2 and 3, consists of a pair of complementary links 12 and 14.

Links 12 and 14 are constructed as complementary parts which are proportioned to fit one within the other and are constructed from sheet metal stock 16 from which the links 12 and 14 are progressively formed by cutting, piercing, embossing, flanging, parting and ultimately shearing the semi-finished part from the stock.

Each link has a flange 18 extending around three of its sides 20, 22 and 24 and is generally rectangular shaped having a major portion consisting of a flat central portion 26 on which useful information can be embossed such as manufacturer's name, the critical temperature at which the fuse is intended to operate, year of manufacture, laboratory testing approvals and the like.

At opposite sides 20 and 24 the flange includes triangularly shaped camming surfaces 28 and 30 for link 12 and confronting coacting camming surfaces 32, 34 for link 14 (see FIGS. 8–11). The entire link including the confronting faces 38, 40 of links 12, 14 has a bright corrosion resistant 4 mil. coating commonly known as "terne coat" this being an art term for a zinc-tin alloy consisting of 85% zinc and 15% tin.

Before the two links are joined, they are first fluxed by dipping the links into a liquid phase flux 41 in container 42 through a clamping member 46 and carrier 48 which rides in a rail 50, the rail having a descending track portion 52 which causes the fuse links to be immersed within the flux and then raised at track section 54, followed by a second dipping, this time within solder 56 in container 58. The clamp 46 and attached links move through track section 60 to effect the solder dip. After soldering, the links are then released into a collection container 62.

The two links are thereafter securely held together by the eutectic temperature solder and each link has an opening 70 adapted for mounting the link in its operative position in a typical manner as shown in FIG. 1.

In the fuse application of FIG. 1, the fuse 10 is held constantly in tension at one end by means of a hook 74 which is received through opening 70 of link 14 and in a second opening 75 of a mounting bracket 76 on housing 78. The fuse is held at the other end through a spring 80 secured under tension and is stretched between 82 in bracket 84 and end 86 through a swivel linkage 88 and hook 90 to opening 70 of link 12.

At the critical temperature (FIG. 1), the two links 12, 14 separate causing the spring 80 to bring switch arm 90 and contact 92 against contact 94 thereby making an electrical circuit connecting the power source or battery 100 with a bell actuator 102 for bell 104. Briefly, the connection consists of conductor 104, bell actuator 102, conductor 106, contact 94, contact 92 of the now closed switch on switch arm 90, conductor 108 to battery 100.

Figure 8:
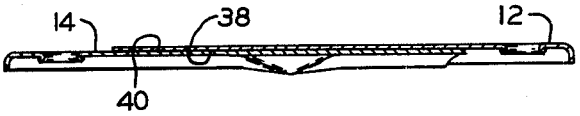
FIG. 8 is a section view taken on line 8—8 of FIG. 2.
Figure 9:
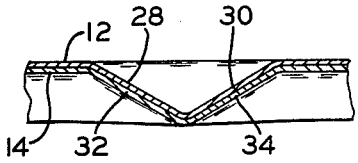
FIG. 9 is an enlarged detail view showing partly in section that portion of the two internested fuse members with the cam surface still interlocked.
Figure 10:
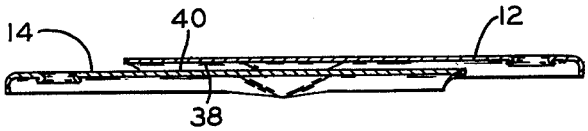
FIG. 10 illustrates the condition when the fuse is operating and the fuse elements are pulling apart, the cam surfaces causing the elements to laterally separate when they are longitudinally pulled apart.
Figure 11:
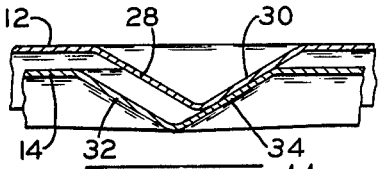
FIG. 11 is an enlarged detail view showing how the confronting cam surfaces of the two link elements ride one over the other from the condition of FIG. 9 to produce lateral separation, insuring a clean break between the soldered surfaces.

To insure that the two links are cleanly separated at the eutectic temperature, the moment the two links tend to move longitudinally the confronting cam surfaces 28 and 30 and opposing cam surfaces 32, 34 of links 12 and 14 will ride against each other, as indicated in FIG. 11, thus lifting the two links laterally apart as shown in FIGS. 10 and 11 and completely separating the fluxed and soldered surfaces 38 and 40 of the two fuse links 12 and 14 (FIG. 8).

Consequently, at the critical temperature instead of merely allowing the two links to "creep" apart and then refuse, which can occur at the critical temperature, almost instantaneously with any type of movement, a clean breaking apart of the two links 12, 14 occurs and there is no opportunity for them to rejoin at any time once the eutectic temperature or critical temperature is reached or exceeded.

At the same time, the surface 26 of link 14 is available for informational embossing including dating, trademarking, approval designation, date of manufacture, temperature of operation and the like. All of this can be accomplished without in any way introducing problems of voids or discontinuities between the surfaces of the links which would otherwise interfere with complete and efficient soldering of the two confronting surfaces, or tuck soldering.

Both the soldering and the fluxing are within the state of the art, and do not form an essential part of the present invention.

Although the present invention has been illustrated and described in a single example embodiment, it will be understood that this is illustrative of the invention and is by no means restrictive thereof. It is reasonably to be expected that those skilled in this art can make numerous revisions and adaptations of the invention and it is intended that such revisions and adaptations will be included within the scope of the following claims as equivalents of the invention.

What I claim is:

1. A process for making fusible links adapted to be temperature responsive for effecting operation of alarms or other devices, comprising the steps of progressively forming from flat sheet metal stock two interfittable rectangular links, bending the outer edge of said links into a flange extending along three of the sides of said link, each of opposite sides of the respective link flanges including complementary inclined camming side which effect lateral spreading movement of the confronting surfaces of said links when they are drawn in opposite directions, "terne" coating the outer surfaces of said link and then flux coating and thereafter soldering the links together with a eutectic solder.

2. The process in accordance with claim 1 including the step of imposing tensile force on the fused links and effecting their breakage part at predetermined temperature by release of the eutectic solder and the camming apart of the two links by the confronting cam surfaces to preclude creep or gradual release of the said fused links.

3. The process in accordance with claim 1 including the step of embossing the substantially flat and uninterrupted exterior surface of one of the pair of said links which is uncovered in the internested position of said two links when they are welded together.

4. The process in accordance with claim 1 wherein said links are "terne" coated to at least 3 mil. thickness.

5. The process for making a pair of interfittable fuse links comprising the steps of cutting from a progressive die the said pair of links, piercing openings in the ends of said links, embossing information on the surface of at least one of said links, flanging three of the edges of each of said links with two of the opposite edges of each of said links including complementary triangular indentations which serve as camming surfaces, parting the completely formed links from sheet metal stock, interfitting respective pairs of links and joining said links by a combination fluxing-and-soldering while the two links are mechanically held together along one edge thereof.

* * * * *